US007753372B2

(12) United States Patent
Wagner et al.

(10) Patent No.: US 7,753,372 B2
(45) Date of Patent: Jul. 13, 2010

(54) APPARATUS FOR OPENING AND DEPOSITING A SIGNATURE

(75) Inventors: Peter Wagner, Gunzgen (CH); Christoph Sägesser, Mägenwil (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/372,046

(22) Filed: Mar. 10, 2006

(65) Prior Publication Data

US 2006/0214367 A1 Sep. 28, 2006

(30) Foreign Application Priority Data

Mar. 10, 2005 (EP) ..... 05405234

(51) Int. Cl.
*B65H 5/12* (2006.01)

(52) U.S. Cl. ..... 271/277; 270/52.14; 270/52.16; 270/52.21; 270/52.22; 270/52.25; 270/52.27

(58) Field of Classification Search ..... 270/52.14, 270/52.16, 52.19, 52.21, 52.22, 52.23, 52.25, 270/52.27; 271/277
See application file for complete search history.

(56) References Cited

U.S. PATENT DOCUMENTS 4,299,378 A * 11/1981 Muller ..... 270/52.27
4,706,950 A * 11/1987 Ruetschle et al. ..... 270/52.28
6,308,945 B1 * 10/2001 Sagesser ..... 270/52.27
6,547,240 B2 * 4/2003 Silberbauer ..... 271/277

FOREIGN PATENT DOCUMENTS

CH 408 065 2/1966
CH 652 103 A5 10/1985

* cited by examiner

*Primary Examiner*—Gene Crawford
*Assistant Examiner*—Leslie A Nicholson, III
(74) *Attorney, Agent, or Firm*—Venable LLP; Robert Kinberg; Justine A. Gozzi

(57) ABSTRACT

An apparatus for opening and depositing a signature onto a transporting device includes a continuously rotating gripper cylinder having a first shaft and carrying at least one signature. First and second opening cylinders are arranged below the gripper cylinder to open the signature and deposit the opened signature onto the transporting device. The first and second opening cylinders each have a second and third shafts, respectively, extending substantially parallel to the first shaft. The first and second opening cylinders each have a peripheral section, the peripheral section of the first opening cylinder engaging in a region of rotation of the gripper cylinder to grip a signature such that the signature can be released again. The first opening cylinder includes a guide element to aid in conveying the signature.

10 Claims, 6 Drawing Sheets

APPARATUS FOR OPENING AND DEPOSITING A SIGNATURE

CROSS-REFERENCE TO RELATED APPLICATION

This application claims the priority of European Patent Application No. 05405234.5-2314, filed on Mar. 10, 2005, the subject matter of which is incorporated herein by reference.

BACKGROUND OF THE INVENTION

The invention relates to an apparatus for opening a signature or printed sheet and depositing it on a transporting device, the apparatus comprising a continuously rotating gripper cylinder, as well as a first and a second opening cylinder arranged below the gripper cylinder, the shafts of which extend substantially parallel to the gripper cylinder shaft. These opening cylinders respectively open one signature and deposit it with the opened side facing downward onto the transporting device, wherein the first opening cylinder engages with a section of its circumference in the region of rotation for the gripper cylinder to grip a signature on the side to be opened, such that it can be released again.

An apparatus of this type is disclosed, inter alia, in Swiss patent document CH 408 065. This apparatus, called a depositing machine therein, functions to remove signatures from a stack and transfer them from the continuously rotating gripper cylinder to opening cylinders, which open the signatures and deposit them onto a circulating transporting device, wherein this transporting device can be a gathering chain which is known per se.

A different apparatus of the aforementioned type is disclosed in Swiss patent document CH 652 103 A. With this apparatus, one opening cylinder is driven with a peripheral speed that is periodically accelerated above and/or delayed below its mean speed. The first opening cylinder passes with a peripheral section and increased speed through the peripheral region of the gripper cylinder and is subsequently delayed, so that the downward speed of the signature reaches a minimum. This is intended to achieve a further increase in the processing. However, this apparatus has the disadvantage that the drive elements are subjected to comparably high wear as a result of the changing loads on the drive. A further disadvantage is that the suction elements of the opening cylinders impact at maximum lag speed with the signatures, thus making it considerably more difficult to maintain the functional safety of the suction opening. Finally, as a result of the delay in the drop speed, large-format signatures cannot be deposited without problems.

SUMMARY OF THE INVENTION

It is therefore an object of the present invention to provide an apparatus of the aforementioned type that avoids the above-mentioned disadvantages.

The above and other objects are achieved according to the invention wherein according to an exemplary embodiment there is provided an apparatus for opening and F depositing a signature onto a transporting device, the apparatus comprising: a continuously rotating gripper cylinder having a first shaft and carrying at least one signature; and first and second opening cylinders arranged below the gripper cylinder to open the signature carried by the rotating gripper cylinder and deposit the opened signature with the opened side facing downward onto the transporting device, the first and second opening cylinders each having second and third shafts, respectively, extending substantially parallel to the first shaft, the first and second opening cylinders each having a peripheral section with a peripheral surface, the peripheral section of the first opening cylinder engaging in a region of rotation of the gripper cylinder to grip a signature on the side to be opened such that the signature can be released again, the first opening cylinder including a guide element that cooperates with the peripheral section of the second opening cylinder to aid in conveying the signature when it is positioned between the first and second opening cylinders.

Thus, according to the invention, the peripheral section of the first opening cylinder, which engages in the rotational region of the gripper cylinder, is provided with a guide element that cooperates with the peripheral section of the second opening cylinder to convey a signature that is positioned between the first and second opening cylinders. A movable guide element is therefore provided, which is driven about the periphery of the first opening cylinder for transporting the signature by cooperating with the second opening cylinder. If a signature is transported between the two opening cylinders, the guide element, so-to-speak, forms an extension of the peripheral section of the first opening cylinder. As a result, it is possible to transport even large-format signatures between the two opening cylinders, essentially by providing guidance up to the fold. Since the guide element is movable, it can be displaced to fit against the peripheral section of the first opening cylinder when gripping an additional signature.

A quieter running apparatus and thus less wear can furthermore be achieved since the first opening cylinder does not have to be accelerated. The uniform driving speed furthermore facilitates the takeover from the gripper cylinder and the deposit of the signatures on the transporting device, for example a gathering chain. The maximum transporting distance can be extended in this way. Owing to the fact that the signature is transferred with uniform speed onto the first and second opening cylinders, the operation of the grippers and the suction openings is ensured even at high speeds. It is furthermore advantageous that the gripper cylinder can be embodied with a comparably small diameter, even if it is provided with two diametrically opposite-arranged grippers.

According to another exemplary embodiment of the invention, the guide element comprises at least one roller which can be placed against the second opening cylinder for transporting the signature. It is preferable if two rollers of this type are provided, arranged at a lateral distance to each other. As a result, a secure guidance of the signatures during the transport can be achieved with relatively simple means.

According to exemplary embodiment of the invention, a mechanical drive is used for moving the guide element. A drive of this type can be realized with comparably few and robust parts and results in a secure operation.

According to a further exemplary embodiment of the invention, the roller movement is controlled by a cam for a control device. A control of this type can be realized cost-effectively and is functionally secure.

Further advantageous features follow from the following description taken in conjunction with the drawing.

BRIEF DESCRIPTION OF THE DRAWINGS

These and other features and advantages of the invention will be further understood from the following detailed description of the exemplary embodiments with reference to the accompanying drawings.

DETAILED DESCRIPTION OF THE INVENTION

Figure 5:
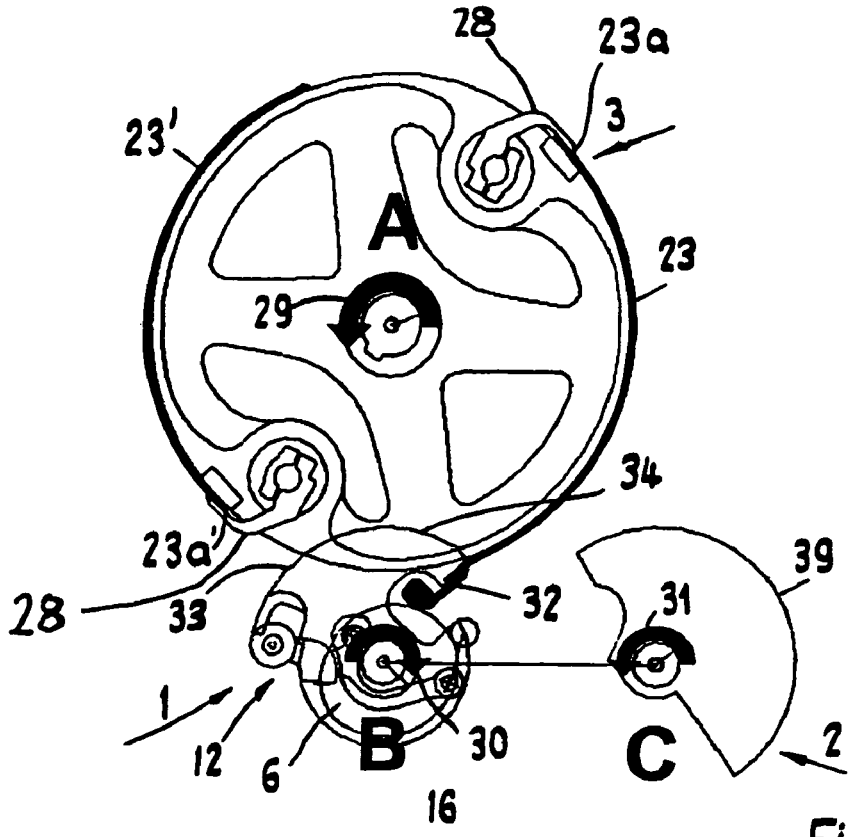
FIGS. 5 to 8 show a schematic view of individual stages, depicting the gripping and transport of a signature with the aid of the apparatus.

Referring initially to FIG. 5, an exemplary embodiment of the invention comprises a gripper cylinder 3 for withdrawing, in a manner known per se, signatures 23 and 23' from a signature stack for a feeder that is not shown herein and transferring these to the opening cylinders 1 and 2. The gripper cylinder 3 comprises a shaft A, which is driven in counterclockwise direction as shown with the arrow 29. Separate grippers 28 hold the signatures 23 and 23' by gripping along a fold 23*a* and/or 23*a*'. Grippers 28 are arranged diametrically opposite each other on the gripper cylinder 3, so that respectively two signatures 23 and 23' can be transported with the cylinder. One of the two signatures 23, 23' positioned on the gripper cylinder 3 is gripped by grippers 32 on the first opening cylinder 1 and is pulled away from the gripper cylinder 3. In FIG. 5, the signature 23 is gripped and pulled away by the first opening cylinder 1. Once the gripper 32 securely grips the signature 23, the gripper 28 releases the signature 23, so that the opening cylinder 1 can now transport it. The signature 23 is then transported in a downward direction between the two opening cylinders 1 and 2 and is simultaneously opened up. Finally, the opened signature 23 is dropped onto a transporting device, not shown herein, which may be a conveying chain. The non-shown transporting device can be, for example, a gathering chain of a gathering and wire-stitching machine which can extend approximately parallel to the shaft A of the gripper cylinder 3 and/or parallel to the shafts B and C of the first opening cylinder 1 and the second opening cylinder 2, respectively. The signatures 23 and 23' may be printed sheets, for example used for producing books, magazines, newspapers and the like.

Figure 1:
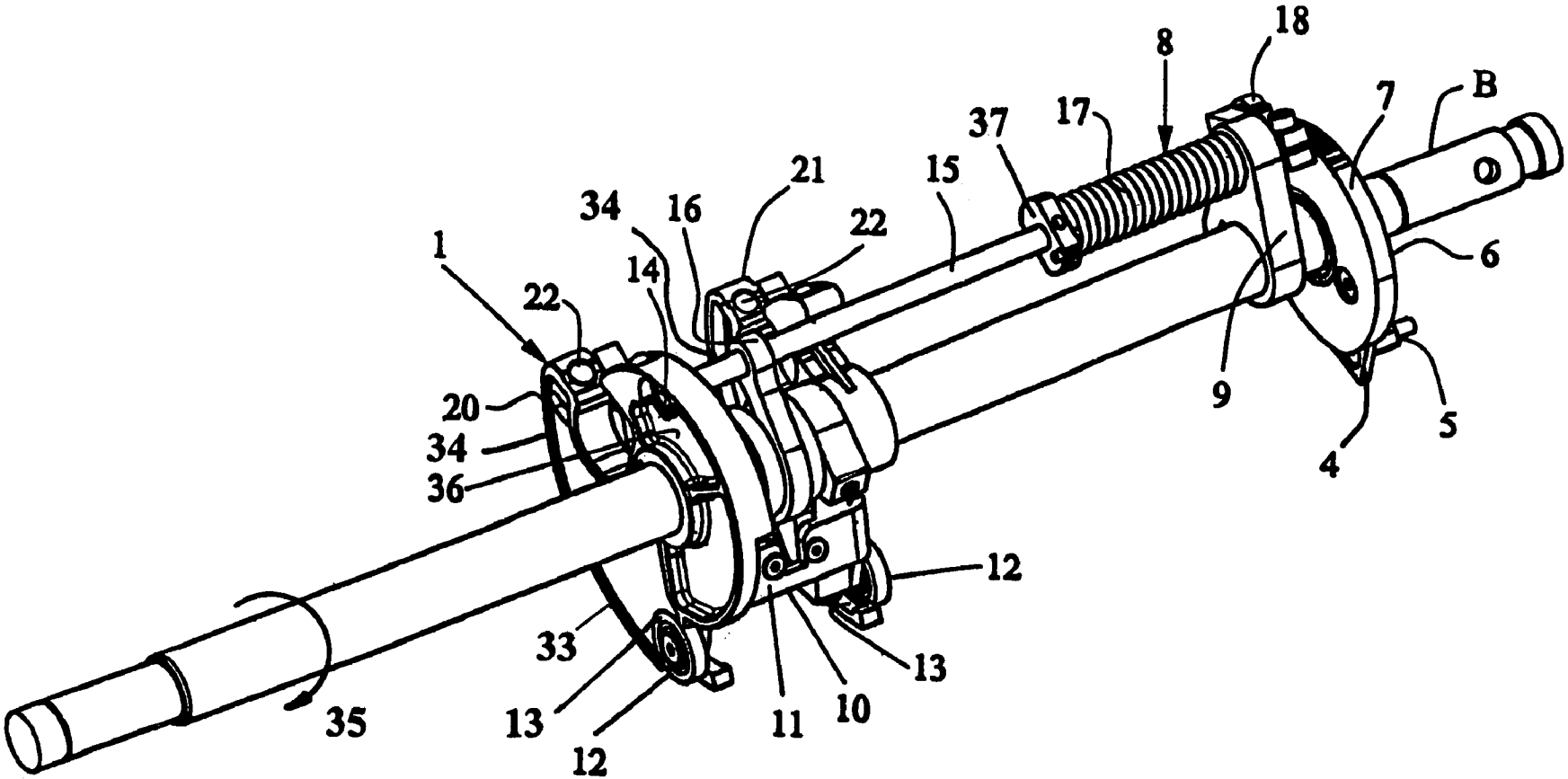
FIG. 1 is a three-dimensional representation of the first opening cylinder.
Figure 2:
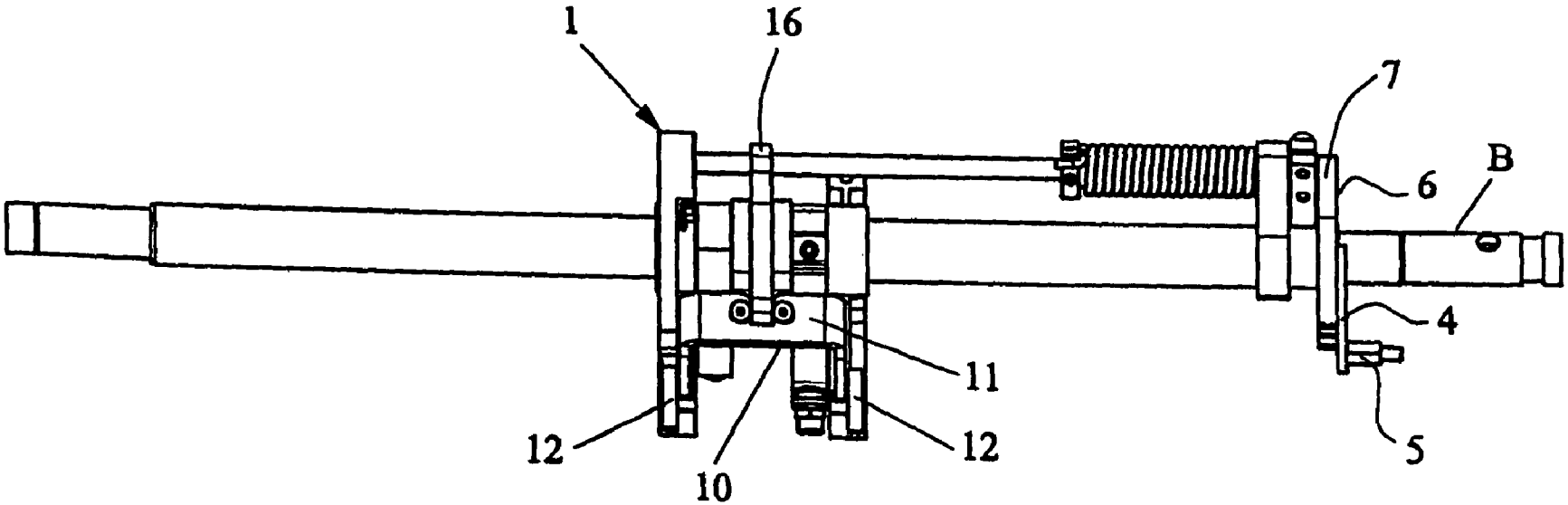
FIG. 2 is a view of the arrangement according to FIG. 1.
Figure 3:
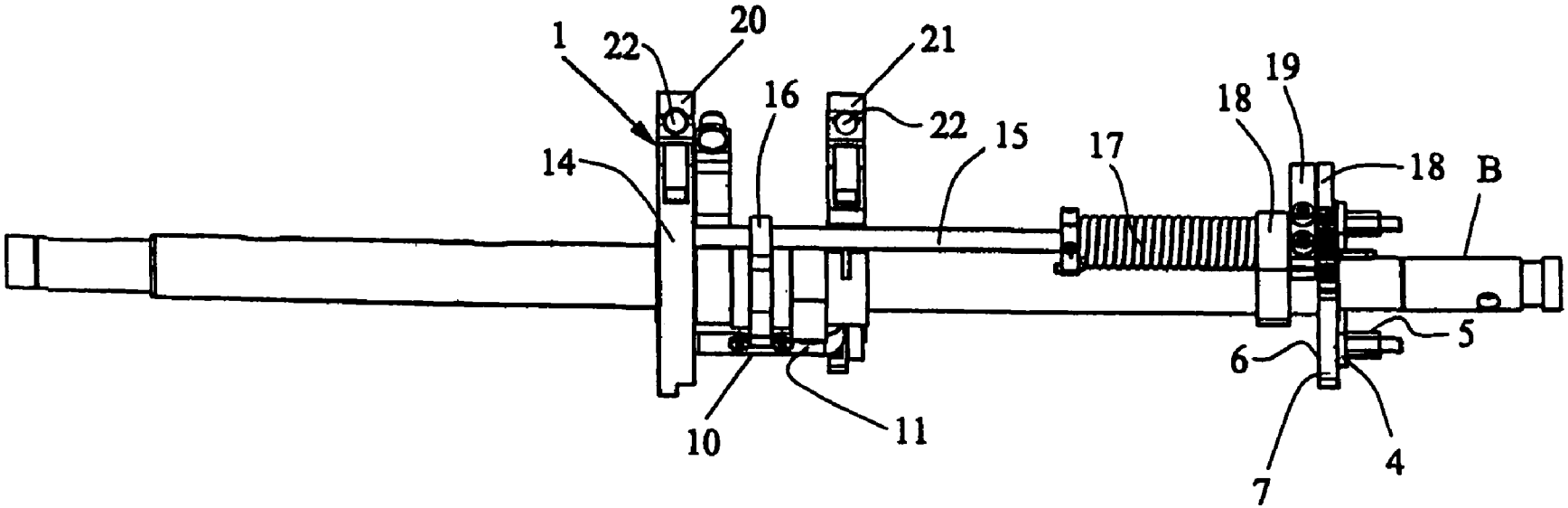
FIG. 3 is a different view of the arrangement according to FIG. 1.

FIGS. 1 to 3 show the first opening cylinder 1 in greater detail, with one end in a bearing plate 4. The bearing plate 4 is fixedly connected with fastening components 5, only indicated herein, to a machine frame that is also not shown herein. The other end of shaft B is positioned in a similar manner on the machine frame. The shaft B and the shafts A and C are driven in a manner known per se, for example by a drive chain not shown herein.

At a distance to the bearing plate 4, the first opening cylinder 1 comprises a first segment 20 and a second segment 21, which are arranged at a distance to each other and are fixedly connected to the shaft B. Both segments 20 and 21 are provided with a clamping element 22, for example made of plastic, which operates jointly with a gripper 32 (see FIG. 5) for gripping a signature 23 and/or 23'. A signature 23 and/or 23', which must be withdrawn, is therefore gripped at two spaced-apart locations between respectively one clamping element 22 and a gripper 32. The control of the grippers 32 is known per se to a person skilled in the art and is therefore not explained in further detail herein.

Each of the two segments 20 and 21 has a section 34, which essentially extends from the clamping element 22 to a recess 13 (see FIG. 1), wherein the angle between the clamping element 22 and the end of the recess 13 is approximately 120°. Between the clamping element 22 and the recess 13, the segments 20 and 21 respectively have a peripheral surface 33 that forms a circular arch with the center located on the longitudinal axis of the shaft B, as shown in FIG. 5. The rotational direction for shaft B is indicated in FIG. 1 with an arrow 35. The two clamping elements 22 thus take the lead and the recesses 13 follow. The peripheral surface 33 extends over an angle that is substantially smaller than 180° and is preferably in the range of 90° to 130°.

As shown in FIG. 1, the two recesses 13 each accommodate one roller that forms a guide element 12. Both guide elements 12 can be swiveled in the rotational direction and counter to the rotational direction, relative to the segment 20, 21, wherein the radial distance to the longitudinal axis of shaft B remains constant.

At the distance between a roller for the guide element 12 and the rotational axis of the first opening cylinder 1, the roller moves fairly precisely along the rotational path for the first opening cylinder 1. A drive 8 may be used for swiveling the guide elements 12 and/or the rollers, wherein this drive preferably is a mechanical drive. In principle, the illustrated drive 8 can be replaced with a different drive. For example, the transport rollers 12 can also be swiveled with the aid of a suitable motor control, wherein a mechanical drive is preferred. According to FIG. 4, the drive 8 is provided with a rod 15 that extends parallel and at a distance to the shaft B, as also shown in FIG. 1. One end of the rod 15 is provided with a roller 14 for positioning the rod 15 in a bearing part 36, such that rod 15 can rotate. A lever 19 is clamped immovably onto the other end of rod 15, so as to rotate along, wherein a cam roller 18 is attached to this lever. The cam roller 18 travels along a cam 6 which is fixedly connected to the bearing plate 4 and thus to the machine frame. The cam roller 18 is pressed with the aid of a spiral spring 17 onto a running surface 7 of the cam 6. The spiral spring 17 rests on the rod 15, as can be seen, and is fixedly connected to a clamping element 37 at one end. The clamping element 9 is fixedly connected to the shaft B and forms an additional bearing for the rod 15. The clamping element 37 is fixedly connected to the rod 15. The clamping element 37 can be loosened and turned in order to adjust the tension of spring 17. The clamping element 37 transmits the tension of the spring 17 to the rod 15, which then transmits the tension via the single-arm lever 19 onto the roller 18 that is pressed against the surface 7 of the cam 6, as previously mentioned.

According to FIG. 5, the cam 6 is not round, so that the spacing between the cam roller 18 and the longitudinal axis of shaft B correspondingly changes during the rotation of shaft B, and the rod 15 is rotated around longitudinal axis B via the lever 19.

Figure 4:
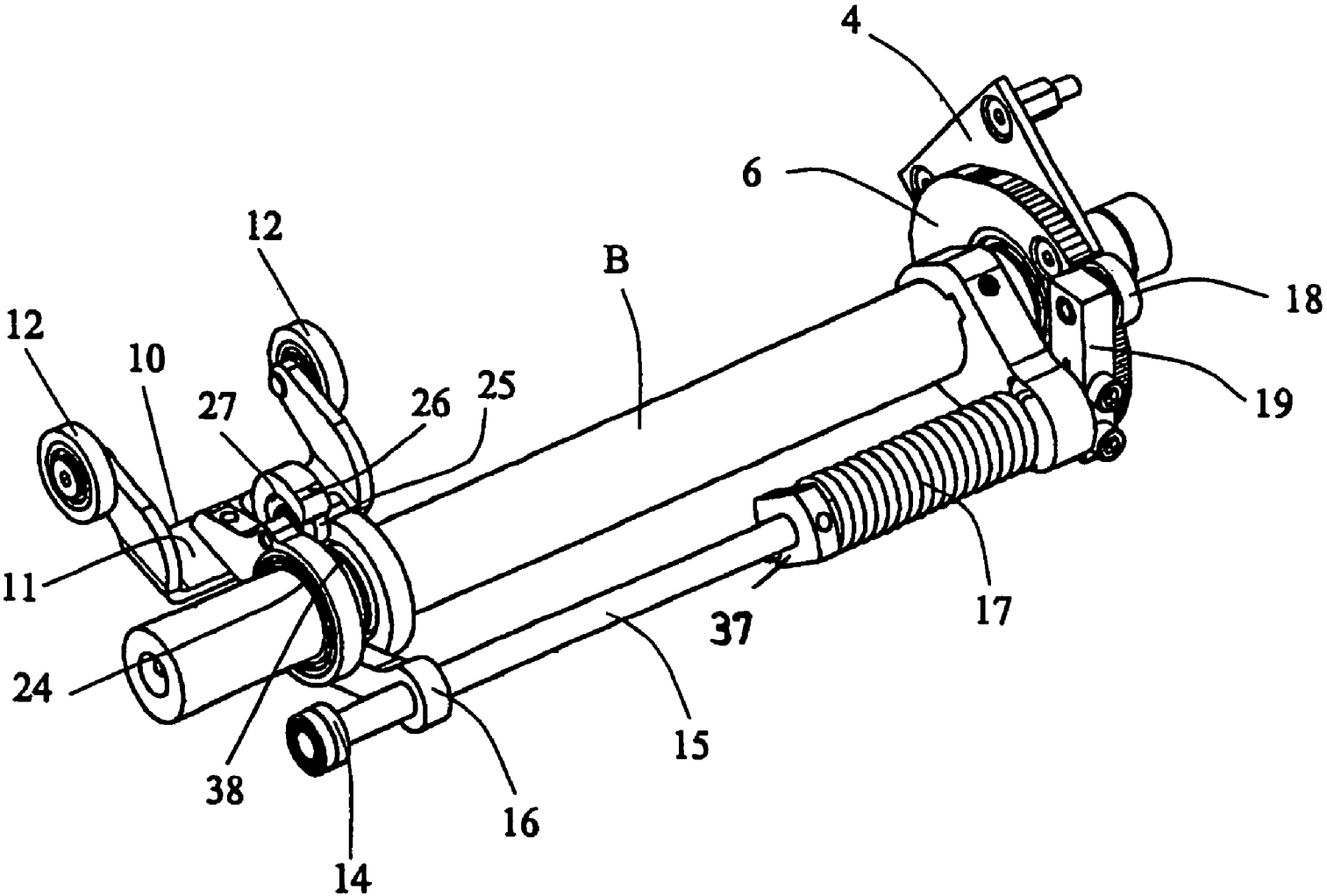
FIG. 4 is a three-dimensional representation of the drive for the guide element.

A hook-shaped driver 16 is attached to the rod 15, such that it can rotate along, at a distance to the bearing roller 14. During the rotation of rod 15, the driver 16 is swiveled around the longitudinal axis of rod 15. As shown in FIG. 4, the driver 16 engages between two rotating bearings 24 of a roller holder 10, arranged at a distance to each other, which serve to position this roller holder such that it can rotate on the shaft B. The roller holder 10 is provided with a yoke 11 on which the two rollers for the guide elements 12 are positioned, spaced apart from side to side, as shown in FIG. 4. A roller 25 is positioned on the holder 10 in an intermediate space 38 between the two rotating bearings 24 on the holder 10, at a distance to the longitudinal axis for shaft B. FIG. 4 shows that the driver 16 encircles this roller 25, positioned inside a recess 27, with its hook-shaped end 26. If the driver 16 is swiveled, then the roller holder 10 is also swiveled in one or the other rotational direction around the longitudinal axis of the shaft B. In the process, the hook-shaped end 26 grips the roller 25 that is connected to the holder 10. As previously mentioned, the radial distance for the two transport rollers 12 relative to the shaft B does not change in that case. The rollers for the guide elements 12 therefore move along a circular path, for which the center is positioned on the longitudinal axis of shaft B.

With the aid of FIGS. 5 to 8, the mode of operation of the apparatus according to the invention is explained in further detail in the following.

Figure 6:
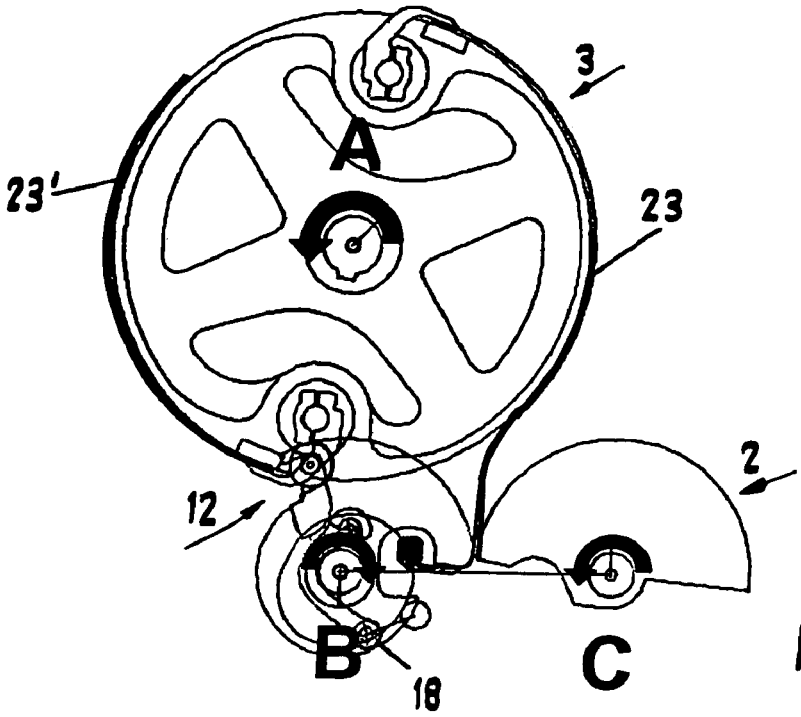

FIG. 5 shows that the first opening cylinder 1 and the second opening cylinder 2 are arranged below the gripper cylinder 3. The first opening cylinder 1 is embodied and arranged so that during rotation of gripper cylinder 3 and the first opening cylinder 1, section 34 of opening cylinder 1 engages in a gap between the signatures 23 and 23' and into the region of the gripper cylinder 3, as shown, so that it can grip the signature 23 with the grippers 32, in a manner known per se. FIG. 5 shows the first opening cylinder 1 immediately after picking up the signature 23 at the open end. The two rollers of the guide element 12 are simultaneously swiveled in clockwise direction, such that they finally come to rest in the recesses 13, as shown in FIG. 6. The rollers 12 also pass through the region of gripper cylinder 3. According to FIG. 6, the grippers 32 in this case are positioned approximately in the three o'clock position.

Figure 7:
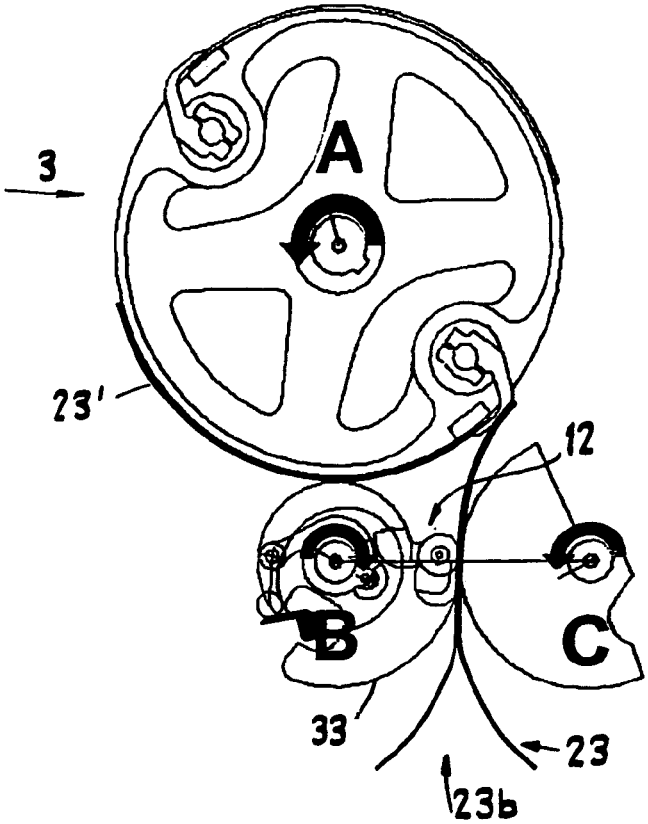
Figure 8:
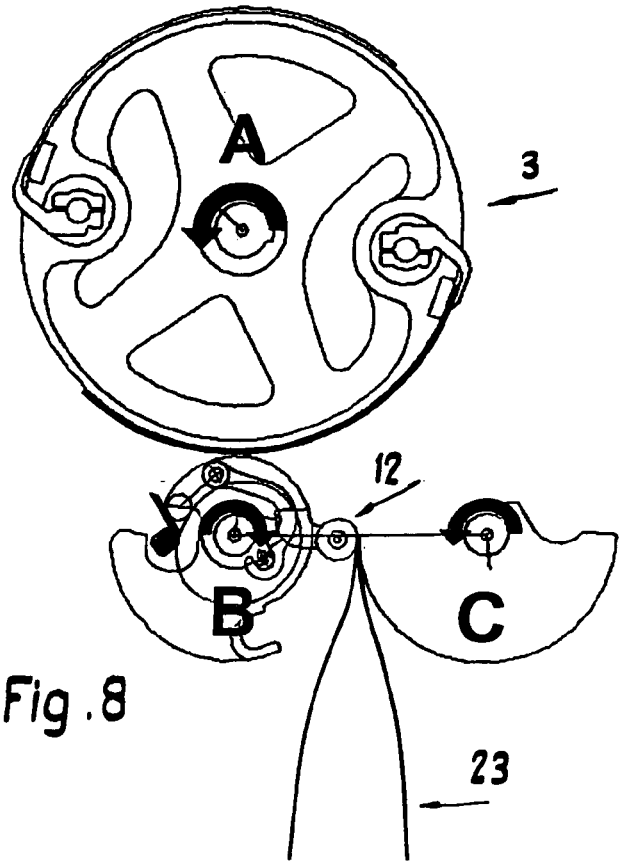

With the first opening cylinder 1, the second opening cylinder 2 is driven simultaneously and moves in counter-clockwise direction, as indicated with arrow 31. The second opening cylinder 2 has a curved outer surface 39 that forms an approximate semi-circle. In the operating phase shown in FIG. 6, the two surfaces 33 and 39 meet, so that the lower end of the signature 23 is gripped with grippers 32 between these two surfaces 33 and 39, along a projecting edge of a facing leg of a signature 23, 23', and is then transported downward. As shown in FIG. 7, in the process the leading side 23*b* of the signature 23 is opened, in a manner known per se, for example by means of suction elements not shown herein.

The two surfaces 33 and 39 jointly transport the signature 23, 23' across an angular region of approximately 90°. Once the end of the surface 33 on the segments 20, 21 is reached, as shown in FIG. 7, the roller guide elements 12 take over the joint further transport. For this, the two rollers are swiveled relative to the shaft B, so that they remain in the illustrated three o'clock position for transporting the signature 23, wherein the drive 8 is used as explained above. The signature 23 is then transported with the aid of the two rollers and the adjacent peripheral surfaces 39 of the second opening cylinder 2. For this, the rollers 12 can rest with tension against the peripheral surfaces 39 and can roll off these surfaces. Once the signature 23 has been transported downward far enough, so that essentially the fold 23*a* of the signature 23 has reached the guide elements 12, the signature 23 that has been opened in the meantime is deposited facing downward onto the transporting device, not shown herein. The two rollers 12 then move with accelerated speed in clockwise direction and finally reach the recesses 13 at the back end of segments 20, 21, as illustrated in FIG. 6. As a result, the following signature 23' can be withdrawn by the gripper cylinder 3, opened and transported in the downward direction. During the complete cycle, the opening cylinder 1 is always driven in the direction indicated with arrow 30.

The gripper cylinder 3 and the opening cylinders 1 and 2 are driven uniformly and with correspondingly high smoothness of running. The guide rollers 12 permit transporting a signature 23 and/or 23' along the peripheral sections 39 of the second opening cylinder 2, up to the ends, even with comparably short peripheral surfaces 33. As a result, even large-format signatures 23 can be transported with guidance over the complete length, for example over a length of 310 mm. According to FIG. 5, the speed of the first opening cylinder 1 when gripping a signature 23 is lower than with a known apparatus having a drive that accelerates and delays, and the signatures 23 can be gripper easier and more securely.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for opening and depositing a signature onto a transporting device, said apparatus comprising:

a continuously rotating gripper cylinder having a first shaft and carrying at least one signature;

a first opening cylinder, wherein the first opening cylinder includes:

a second shaft extending substantially parallel to the first shaft, a first peripheral section including a front end and a back end as seen in a direction of rotation of the first opening cylinder and including a first peripheral surface positioned between the front end and the back end, wherein the first peripheral section engages in a region of rotation of the gripper cylinder to grip the signature on a side to be opened such that the signature can be released again, the region of rotation including a zone within the circumference of the rotating gripper cylinder, and a guide element arranged to swivel on the second shaft, the guide element being housed in a recess in the back end; and a second opening cylinder, wherein the second opening cylinder includes:

a third shaft extending substantially parallel to the first shaft, a second peripheral section with a second peripheral surface, wherein the first opening cylinder and the second opening cylinder are arranged below the gripper cylinder to open the signature carried by the rotating gripper cylinder and deposit the opened signature with the opened side facing downward onto the transporting device, wherein the guide element cooperates with the second peripheral surface to aid in conveying the signature when the signature is positioned between the first opening cylinder and the second opening cylinder.

2. The apparatus as defined in claim 1, wherein at least the first opening cylinder is driven with a constant rotational speed.

3. The apparatus as defined in claim 1, wherein the front end includes a gripper which grips the signature on the side to be opened.

4. The apparatus as defined in claim 1, wherein the guide element in a non-operational position is arranged behind the first peripheral section as seen in the rotational direction.

5. The apparatus as defined in claim 4, wherein the guide element is movable relative to the first peripheral section and is nearly at a standstill in one operational position for the conveying operation, and is subsequently accelerated to move to the non-operational position at the back end of the first peripheral section as seen in the rotational direction of the first opening cylinder.

6. The apparatus as defined in claim 1, wherein the guide element is constructed to roll off the signature resting against the second peripheral surface.

7. The apparatus as defined in claim 6, wherein the guide element comprises a roller that can rotate.

8. The apparatus as defined in claim 1, further including a control device and a lever, wherein the guide element is drive-connected by the lever that operates jointly with the control device.

9. The apparatus as defined in claim 1, wherein a greatest distance between the guide element and a rotational axis of the first opening cylinder nearly corresponds to a radial distance for a circulation path of the first opening cylinder.

10. The apparatus as defined in claim 1, wherein the second peripheral section is larger than the first peripheral section.

* * * * *